US006012166A

United States Patent [19]

Burbidge

[11] Patent Number: 6,012,166

[45] Date of Patent: Jan. 11, 2000

[54] HOSPITAL GOWN

[76] Inventor: Nancy Burbidge, 100 Bain Avenue, #44 The Oaks, Toronto, Ontario, Canada, M4K 1E8

[21] Appl. No.: 08/877,883

[22] Filed: Jun. 18, 1997

[51] Int. Cl.[7] ..... A41B 1/00

[52] U.S. Cl. ..... 2/83; 2/114

[58] Field of Search ..... 2/114, 100, 105, 2/106, 69, 51, 83

[56] References Cited

U.S. PATENT DOCUMENTS

| | | | |
|---|---|---|---|
| 459,106 | 9/1891 | Fifield | 2/114 |
| 818,351 | 4/1906 | Clark | 2/114 |
| 1,489,046 | 4/1924 | Thompson | 2/114 |
| 3,116,491 | 1/1964 | Previdi et al. | 2/106 |
| 3,397,406 | 8/1968 | Leach | 2/114 |
| 3,464,063 | 9/1969 | Hoegerman | 2/114 |
| 4,547,907 | 10/1985 | Netsky | 2/114 |

*Primary Examiner*—Gloria Hale

[57] ABSTRACT

A hospital gown comprises first and second panels which are releasably secured along an edge region of each panel to one another by a plurality of spaced apart tie ups. Each tie up comprises a pair of tie strings on the first panel and a loop on the second panel. The tie members on the first panel are tied to one another through the loop on the second panel which holds the two panels against one another at each of the tie ups.

5 Claims, 6 Drawing Sheets

9
15a
15
9a
4b
6a
6b
3b
3
7
4b
7a
7a
7a 15b
9
15
15a
4a
6b
6a
11
11a
11a
5a
5

HOSPITAL GOWN

FIELD OF THE INVENTION

The present invention relates to a tie up hospital gown.

BACKGROUND OF THE INVENTION

Wearing a hospital gown in a public area within a hospital can be a very humbling and humiliating experience. These gowns are typically in the form of a long shirt-like structure with ties along each free edge of the gown. The gowns often tie up at the back of the patient.

Even when the ties are properly tied with one another, there are large gaps left between each tie through which the user of the gown is exposed.

SUMMARY OF THE PRESENT INVENTION

The present invention provides a hospital gown which uses a new form of tie ups for hospital gowns which are easy to maneuver by the user and which provide a very effective closing of the gown. More particularly, the hospital gown of the present invention comprises first and second panels which are releasably secured along an edge region of each panel to one another by a plurality of spaced apart tie ups. Each of the tie ups comprises a pair of male tie members, both of which are provided on the first panel and female receptacle which is provided on the second panel. The two tie members on the first panel are tied through the receptacle on the second panel holding the two panels against one another at each of the tie ups.

BRIEF DESCRIPTION OF THE DRAWINGS

The above as well as other advantages and features the present invention will be described in greater detail according to the preferred embodiments of the present invention in which.

DETAILED DESCRIPTION ACCORDING TO THE PREFERRED EMBODIMENTS OF THE PRESENT INVENTION IN WHICH

Figure 1:
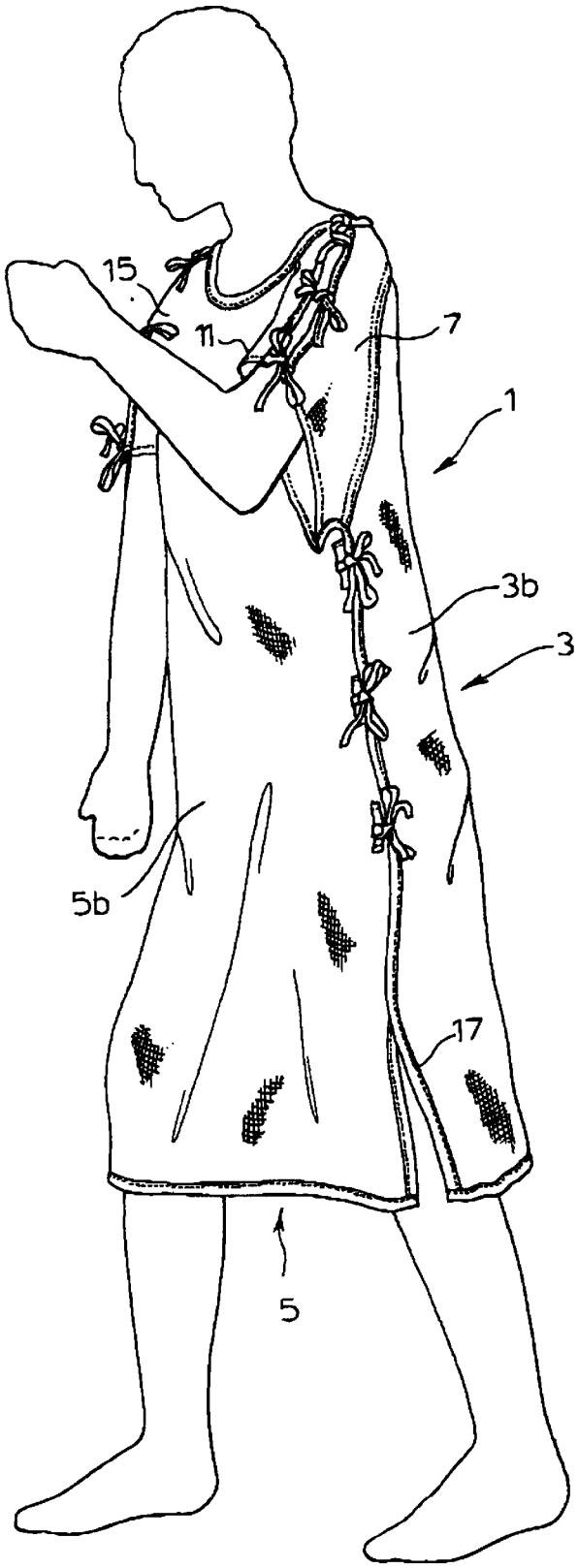
FIG. 1 is a perspective view of a person wearing a hospital gown in accordance with a preferred embodiment of the present invention.
Figure 2:
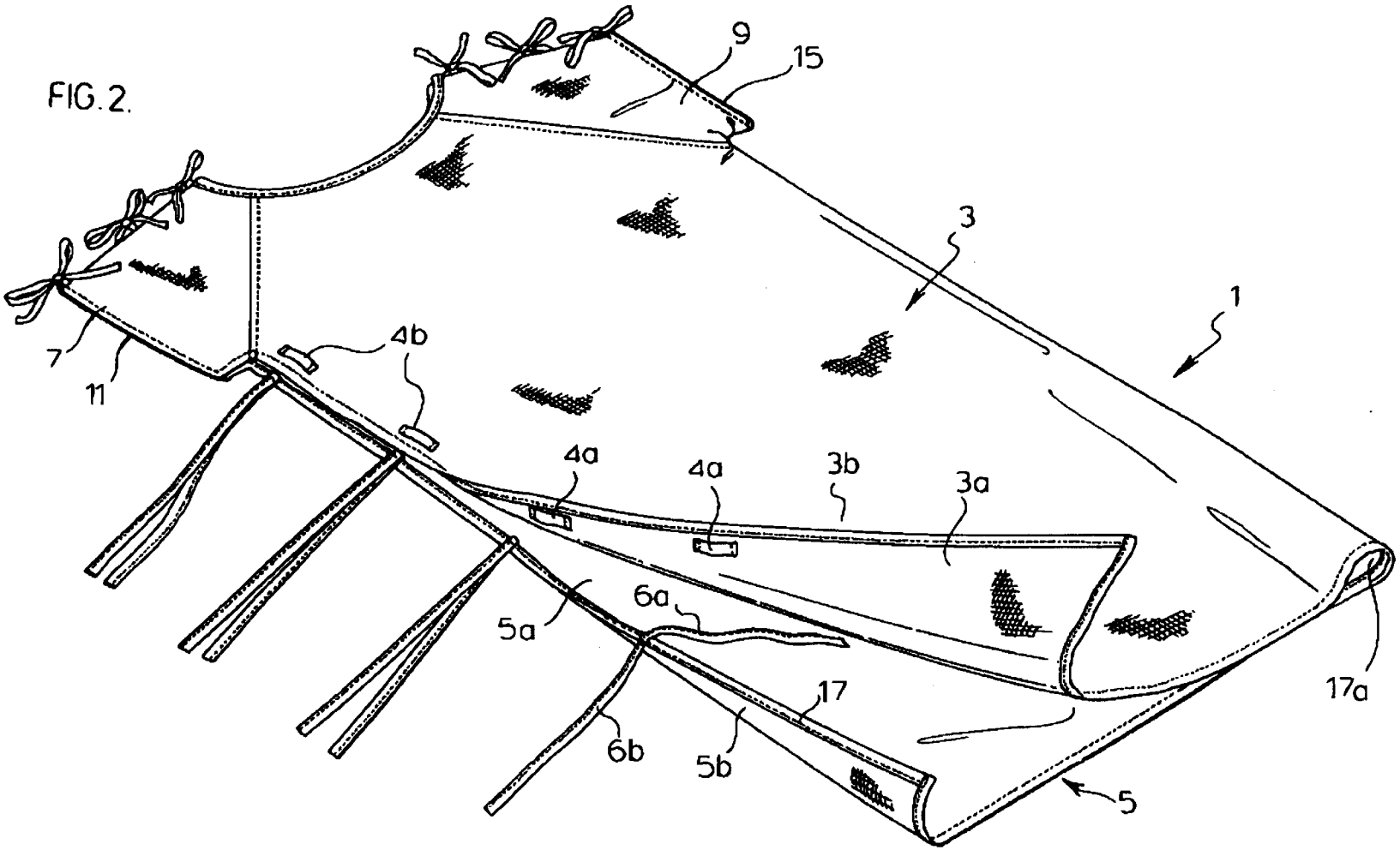
FIG. 2 is a perspective view of the hospital gown of FIG. 1 in a closed position.
Figure 3A:
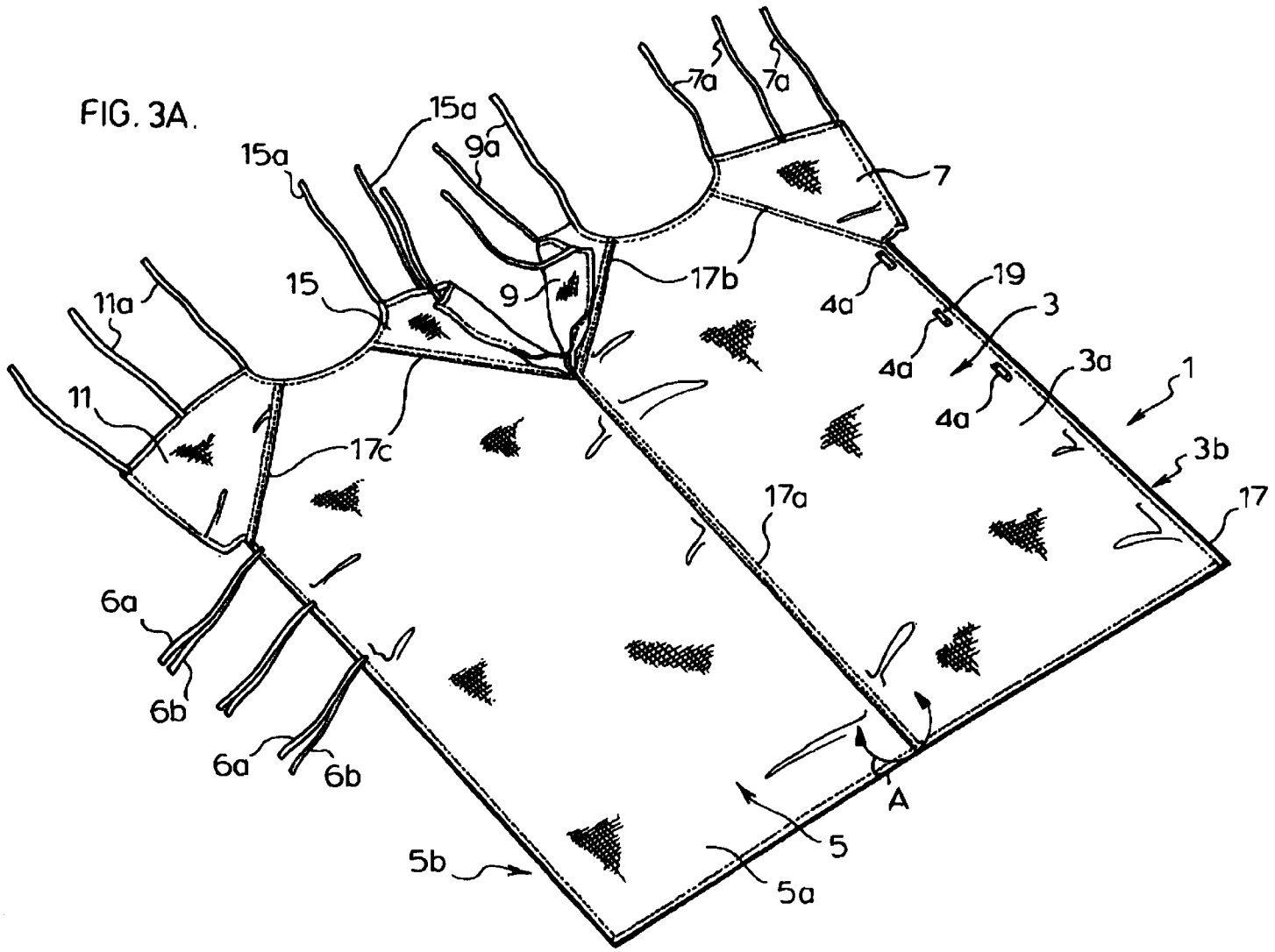
FIGS. 3*a* and 3*b* are perspective views of the hospital gown of FIG. 1 in an open position.
Figure 3B:
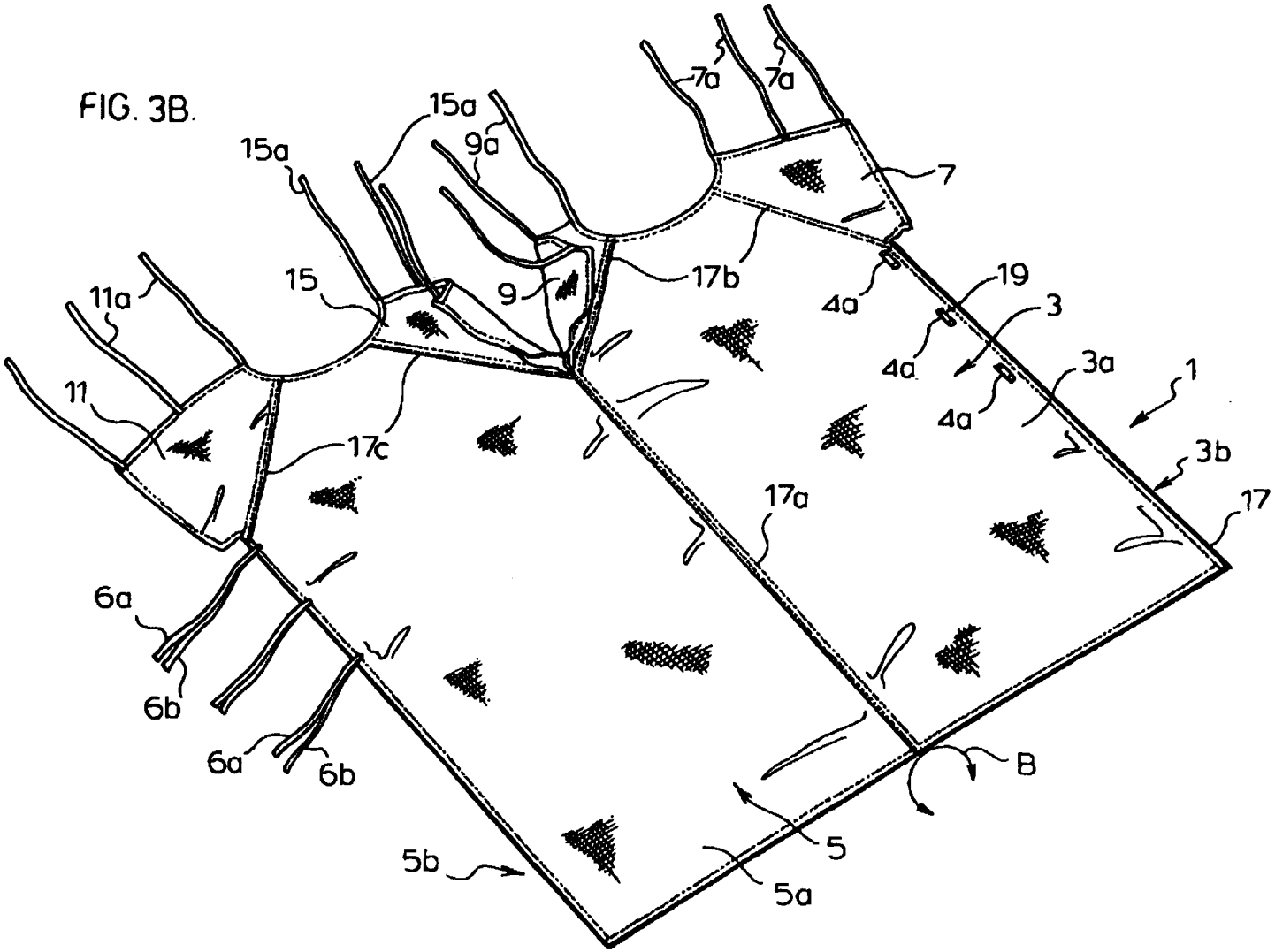

FIG. 1 shows a hospital patient wearing a hospital gown generally indicated at 1. This gown, as better seen in FIGS. 2, 3*a* and 3*b*, is formed from a pair of preferably cloth panels 3 and 5 permanently attached along one edge of each of the panels by a reinforced seam 17*a*. This seam is formed by folding each panel edge and then securing, as for example by stitching the two panels edges to one another. This then provides a reinforced fold region centrally of the gown and about which the two panels are folded in a number of different ways as to be described later in detail.

FIGS. 3*a* and 3*b* show that the gown has other reinforced areas such as for example, reinforced edge region 17 peripherally of the gown and reinforced shoulder regions 17*b* and 17*c*. The edge or periphery reinforcement 17 is simply a folding and stitching of the material of each panel whereas the shoulder reinforcement 17*b* and 17*c* is a folding and stitching of joined together body and sleeve panel portions. More particularly, sleeve panels 7 and 9 are joined to the first body panel 3 at the reinforced region 17*b* and sleeve portions 11 and 15 are secured to the second body panel 5 at reinforced regions 17*c*.

The sleeve portions 7, 9, 11 and 15 are respectively provided with ties 7*a*, 9*a*, 11*a* and 15*a*. These ties are preferably stitched to the reinforced edge of the gown.

Panel 3 has opposite side faces 3*a* and 3*b*. Provided on the face 3*a* are a plurality of spaced apart loops 4*a*. These loops are located inwardly from the reinforced edge 17 of the gown by a short distance indicated at 19.

FIG. 2 of the drawings, which depicts the gown in a folded condition shows that a second set of loops 4*b* are provided on the second face 3*b* of the panel 3. In other words, both faces of the panel 3 are provided with spaced apart loops moved inwardly from the edge 17 of the gown.

Provided on panel 5 are a pair of tie members or tie strings 6*a* and 6*b* which are attached at their inner ends to the faces 5*a* and 5*b* respectively of the panel 5. Both of the tie members are preferably stitched to the opposite sides of the reinforced edge 17 of the panel.

A number of important benefits and features of the present invention are provided as a result of the tie up system used with the gown. One of those features is that the use of two tie members on one panel tied through a loop on the other panel results in the edges of the two panels being pulled tightly together with one another. This feature is further enhanced by the fact that the loops on the one panel are spaced inwardly from the free edge of the panel ensuring that the panel edge provided with the ties overlaps or pulls across the panel edge provided with the loops. This essentially eliminates any gaps between the panel edges from one tie up to the next.

Another important feature of the gown of the present invention is that it is used with the tie ups at the side of the gown with the panels being located at the front and the back of the gown. This is not acceptable with traditional gowns where the exposure between the panel edges can be quite embarrassing and which is not a problem with the present invention because the panel edges remain closed against one another for the reasons described above.

Figure 4A:
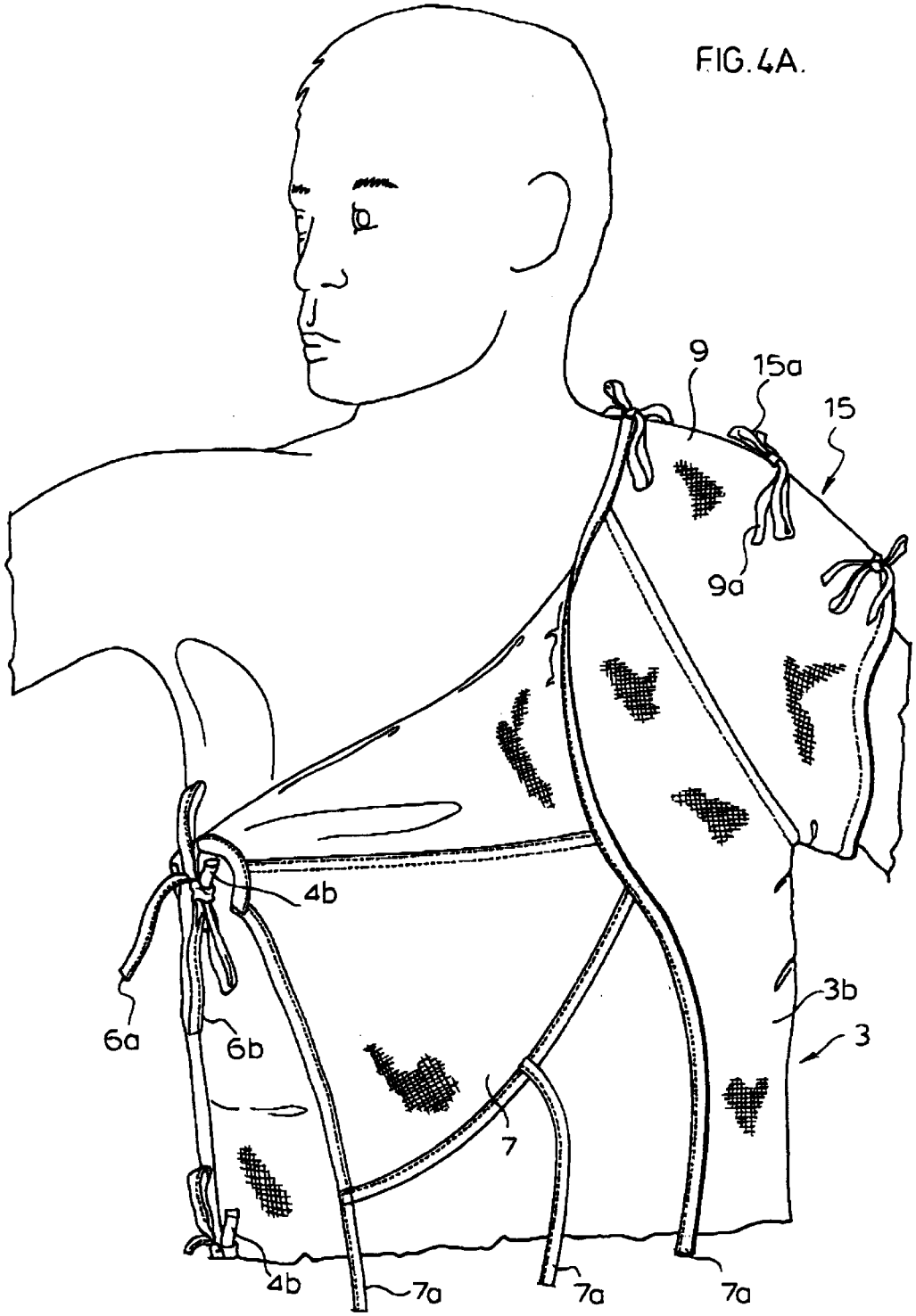
FIGS. 4*a* and 4*b* are perspective views showing a person partially dressed with the hospital gowns of FIGS. 3*a* and 3*b* respectively.
Figure 4B:
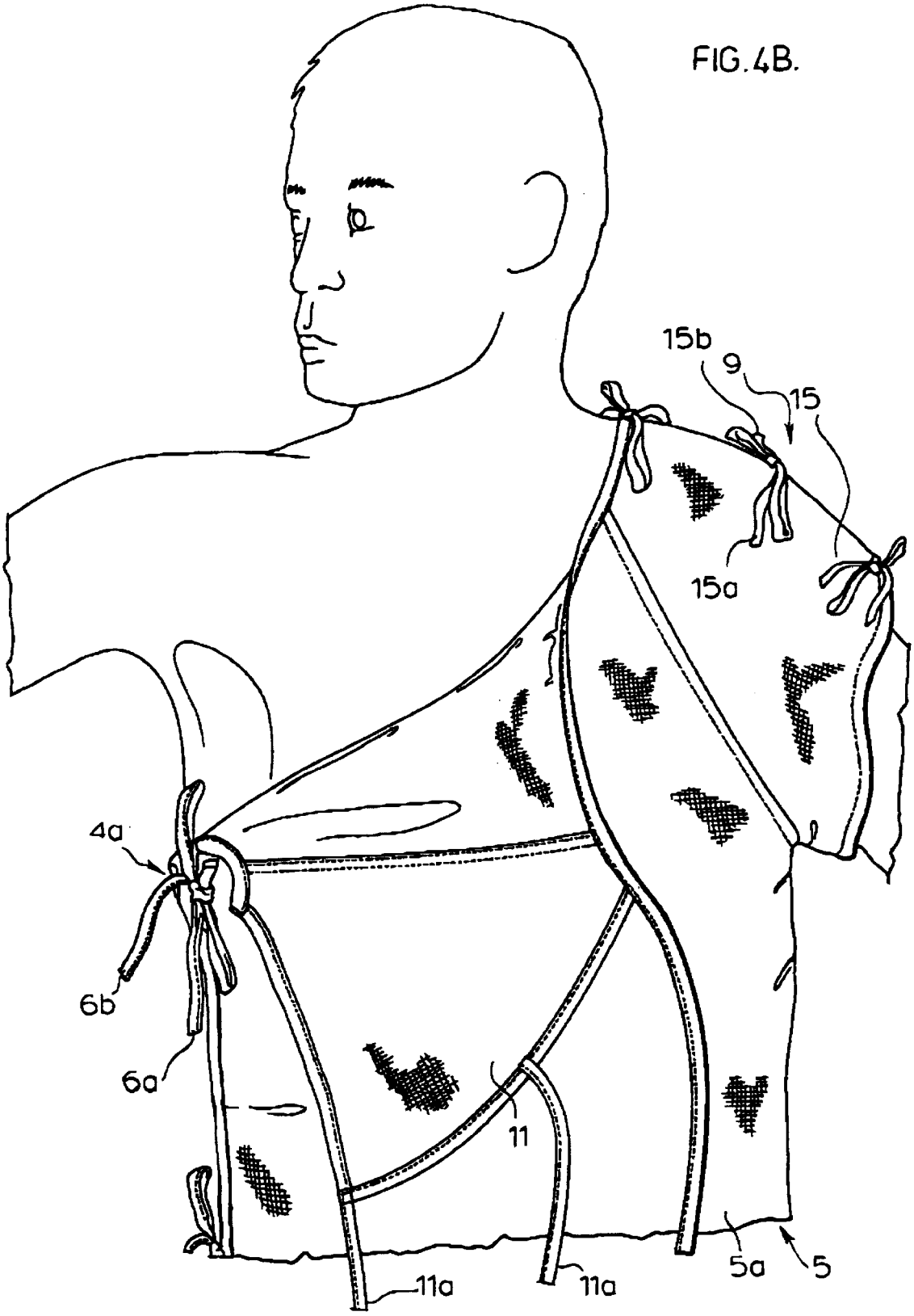

The tie ups can be positioned to either the right or the left hand side of the user as will be seen in comparing FIG. 1 with FIGS. 4A and 4B depending upon which position is more comfortable or appropriate for the user.

A very important feature of the present invention is that the gown can be folded in different directions about the fold line 17*a* as indicated by the arrows A and B in FIGS. 3*a* and 3*b*. FIG. 4*a* shows the gown on the patient when it is folded in the direction of arrow A of FIG. 3*a*. This places the panel 3 to the front of the gown with panel face 3*b* exposed at the front of the gown. At the same time, panel 5 is located to the rear of the gown with panel face 5*b* exposed to the back of the gown.

With the gown folded about the patient as described immediately above, loops 4b on the panel face 3*b* are exposed to the front of the gown so that the ties 6*a* and 6*b* can be tied through the loops 4*b*. Loops 4*a* are hidden inside the gown.

It will be seen with the gown folded around the patient in the FIG. 4 position that sleeve portion 9 is at the front of the gown and sleeve portion 15 is at the rear of the one side of the gown while the sleeve portion 7 will be located to the front and the sleeve portion 11 will be located to the rear at the other side of the gown. Although they could be used, there is no need for loops along the shoulders of the gown since this is not generally an area where privacy is required. Therefore, the two sleeve portions on each side on the front and the back of the gown are tied together using tie strings from the respective sleeve portions.

FIG. 3*b* shows the gown folded in the direction of arrow B to wrap around a patient as shown in FIG. 4*b*. In this case, panel 5 is located to the front, while panel 3 is located to the rear of the gown. More importantly, panel faces 5*a* and 3*a* are exposed at the front and the rear of the gown, i.e. the gown is inside out relative to the FIG. 4*a* folding of the gown. This means that any stains or the like appearing on faces 3*b* and 5*b* which remain, even after cleaning, are hidden to the inside of the gown. Accordingly and in contrast to previous practice, a stained but otherwise acceptable gown does not need to be discarded thereby substantially increasing the life span of the gown.

In the FIG. 4*b* position, the loops 4*a* will be located to the outside of the gown at its back edge for receiving the ties 6*a* and 6*b*. Once again, the overlap of the panel edges will be maintained because of the exposure and positioning of the loops slightly spaced from the free edge of the back panel.

Also in the FIG. 4*b* position, sleeve panel 15 is located at the front while sleeve panel 9 is located at the back to the one side of the gown while sleeve panel 11 will be located to the front and sleeve panel 7 will be located to the back at the other side of the gown.

FIGS. 4*a* and 4*b* additionally show the feature that although the gown can be completely opened, other than along fold seam 17*a*, one of the two shoulders can be left tied up allowing the other shoulder and the releasable side of the gown to be opened. Furthermore, both shoulders can remain tied allowing the gown to be slipped over the user's head and then tied along the one side only.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A hospital gown comprising first and second panels secured to one another along a gown edge which is foldable and which is reversible in direction of folding between a first and a second folded position, said first and second panels each having first and second faces which are located interiorly and externally respectively of the gown with said first edge of the gown in the first folded position and which are located exteriorly and interiorly respectively of the gown with said first edge of the gown in the second folded position, said panels each having panel edge regions, the panel edge region of said first panel having first and second tie strings and the panel edge region of said second panel being provided with first and second loops, one on each face of said second panel, said first loops being positioned exteriorly of said gown to receive said ties and to hold said panel edge regions against one another with the gown edge in the first folded position and said second loops being positioned exteriorly of the gown to receive said ties and hold the panel edge regions against one another with the gown edge in the second folded position.

2. A hospital gown as claimed in claim 1, wherein the panel edge region of said second panel comprises said first and second loops, a free edge on said second panel and an intervening piece of panel material spacing said first and second loops from said free edge of said second panel.

3. A hospital gown as claimed in claim 2, wherein said panel edge region of said first panel overlaps said panel edge region of said second panel when tied with one another.

4. A hospital gown as claimed claim 1, wherein said gown is reinforced by a thickened region of gown material peripherally of said gown.

5. A hospital gown as claimed in claim 4, wherein said ties are secured to said thickened region of gown material, said first tie extending from said first face and said second tie extending from said second face of said first panel.

* * * * *